United States Patent [19]

Blackburn

[11] Patent Number: 4,897,916

[45] Date of Patent: Feb. 6, 1990

[54] METHOD FOR MAKING A TRANFORMER CORE ASSEMBLY

[75] Inventor: Raymond L. Blackburn, Crystal Lake, Ill.

[73] Assignee: Coils, Inc., Huntley, Ill.

[21] Appl. No.: 300,410

[22] Filed: Jan. 17, 1989

Related U.S. Application Data

[62] Division of Ser. No. 237,056, Aug. 29, 1988, Pat. No. 4,827,237.

[51] Int. Cl.[4] ..... H01F 41/02

[52] U.S. Cl. ..... 29/609; 336/216; 336/217; 336/234

[58] Field of Search ..... 29/609, 602.1; 336/234, 336/216, 217

[56] References Cited

U.S. PATENT DOCUMENTS 3,793,129 2/1974 Doggart et al. ..... 336/216

4,711,019 12/1987 Albeck et al. ..... 29/609

*Primary Examiner*—Carl E. Hall

*Attorney, Agent, or Firm*—Thomas R. Vigil

[57] ABSTRACT

The transformer core assembly comprises a first stack of laminations having an "E" shape and including at least three legs comprising first and second, outer legs and a third, middle leg, and a second stack of laminations interlocked with the first stack by mechanical engagement of said second stack with the distal ends of the legs of said first stack. Each first and second outer leg has an identical distal end formation adapted to engage a mating formation on the second stack. The middle leg has a third distal end formation which includes an outer end surface and inner end surface offset inwardly from said outer end surface and an inclined surface between the outer and inner end surfaces. A mating formation is provided on the second stack which is substantially a mirror image of the third distal end formations, but with an inclined surface of the mirror image mating formation being slightly offset laterally or transversely of the inclined surface of the third distal end formations of the third middle legs thereby to provide a slight interference fit between the first stack and the second stack so that, upon engagement of the first and second stacks, the formations on the distal ends of all three legs are urged transversely against the opposed mating formation on the second stack.

7 Claims, 4 Drawing Sheets

FIG. 13
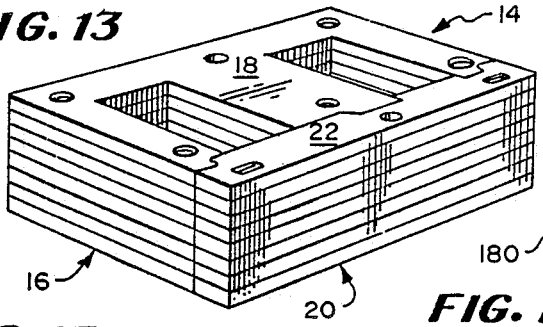
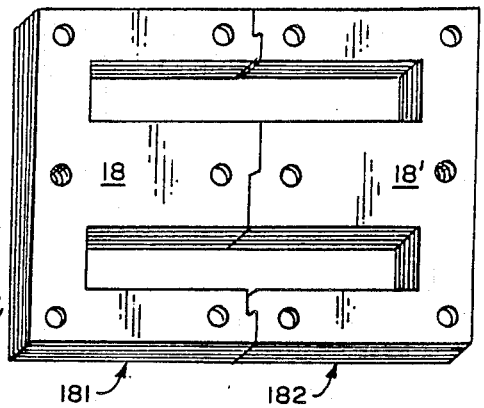
FIG. 14
FIG. 15
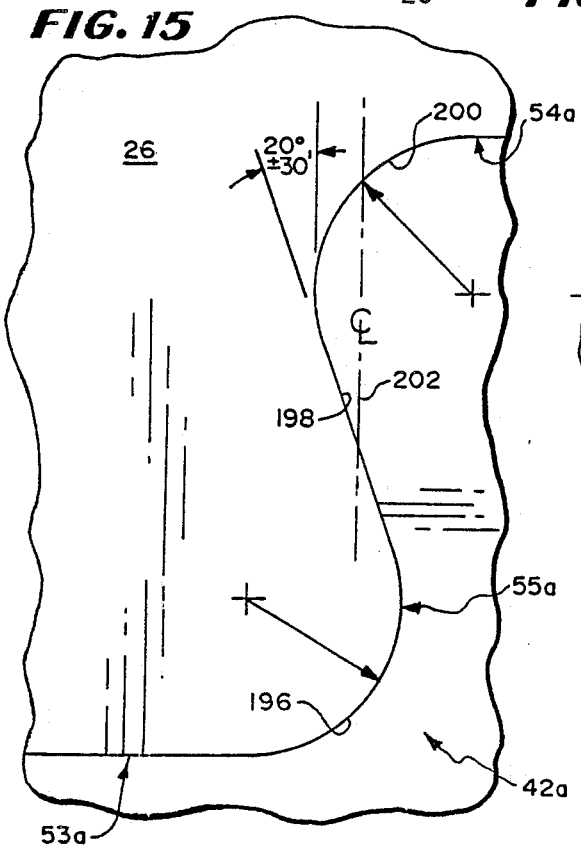
FIG. 16
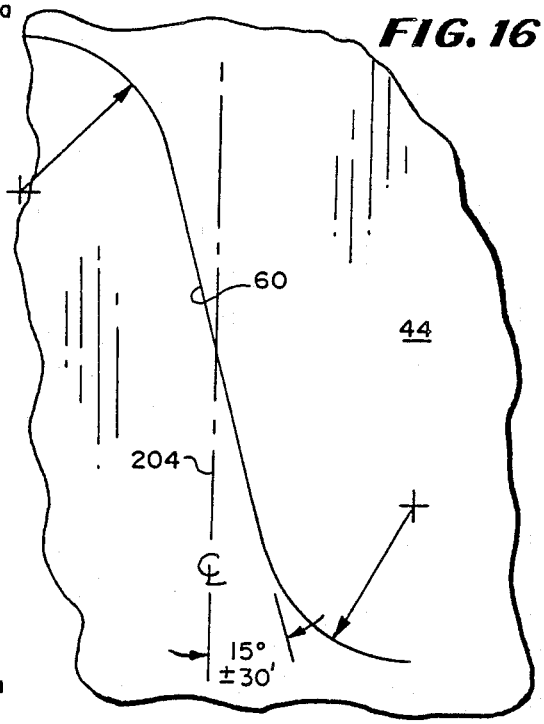
FIG. 17
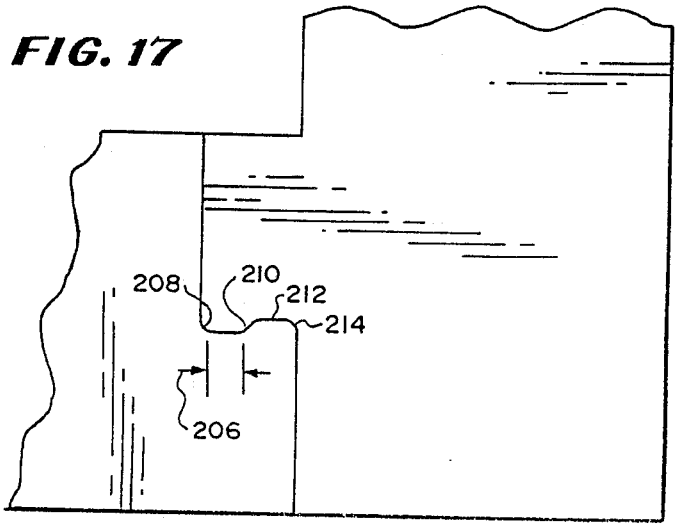

METHOD FOR MAKING A TRANFORMER CORE ASSEMBLY

BACKGROUND OF THE INVENTION

1. Field of the Invention

The present invention relates to laminations which are formed into lamination stacks and a transformer core assembly made by forcing two aligned stacks of the laminations into a tight mechanical engagement with each other.

2. Description of the Prior Art

Heretofore designs or configurations of laminations and lamination stacks for forming lamination transformer core assemblies have been proposed. Examples of several previously proposed laminations, lamination stacks and transformer core assemblies made therefrom are disclosed in the following U.S. patents:

| U.S. Pat. No. | Patentee |
|---|---|
| 1,512,032 | Ledwinka |
| 2,137,433 | Wirz |
| 3,587,020 | Waasner |
| 4,414,521 | Reisem |

Other examples are disclosed in the Kammeyer German Published Patent Application No. 2,139,010 and the Blum French Patent No. 1,558,102.

The prior patent publications referred to above disclose a variety of lamination configurations including "E" laminations adapted to be formed in a stack and joined with a similar stack of "E" shaped laminations and transformers which include a stack of shaped laminations fixed to a stack of shaped laminations. Such prior art laminations and stacks formed thereby also include "F" shaped laminations where the interior leg of the "F" shaped lamination has an inclined surface for engaging and camming (or bearing) against a like inclined surface on an identical shaped lamination (see Published German Patent Application 2,002,737).

Furthermore, some prior art laminations provide an end formation at the end of an outer leg of an "E" shaped lamination which has an inner surface, an outer surface and an "S" shaped surface connecting the inner and outer surfaces for engagement with a mating configuration on the side edge of an "I" shaped lamination (see French Patent No. 1,558,102).

As Will be described in greater detail hereinafter, the transformer core assembly of the present invention differs from previously proposed laminations, lamination stacks and core assemblies therefrom by providing lamination stacks having at least one stack of "E" shaped laminations with the middle leg of the "E" shaped lamination having an outer end formation including an outer surface, an inner surface and an inclined surface therebetween with the inclined surface on a mating stack of laminations ("I" or "E") being offset transversely of the elongate axis of the leg so that there is a transverse camming action when the stacks of laminations are joined together on this construction. The end formation on one outer leg of the "E" is identical to the end formation on the outer leg of the other leg of the shaped lamination, with each such end formation including an outer surface, an inner surface and a generally "S" shaped surface therebetween adapted to engage and mate with a mating configuration on a side edge of an "I" lamination and with the inclined camming surfaces causing the mating "S" shaped surfaces on the side edge of the "I" lamination to be urged toward the respective "S" shaped surfaces on the end formations of the first and second outer legs of the "E" shaped lamination.

Additionally the pieces of lamination in each of the mating stacks of laminations are punched from the same area in a sheet of lamination blank material and the lamination pieces in one stack are arranged upside down relative to the pieces in the other stack so that the burr edge at the corner of each lamination in one stack is on one side of each lamination and the burr edge of each lamination on the other stack is on the other side so as to provide a better nesting or mating fit between the lamination stacks when they are forced together.

Furthermore, depressed areas are provided in the lamination stacks, either circular or rectangular in shape, so as to provide a recess on one side of each lamination and a detent on the other side of each lamination to facilitate interlocking engagement of the laminations when they are press fitted against each other.

SUMMARY OF THE INVENTION

According to the invention, there is provided a method for forming a transformer core assembly with a mechanical interference fit between first and second lamination stacks forming the transformer core assembly, said method comprising the steps of: providing two stacks of laminations; providing identical coupling formations at two spaced apart locations on one side of one stack of laminations; providing offset side surfaces connected by an inclined surface intermediate the two coupling formations; providing one side of the other stack of laminations with a mating configuration; providing a dimension, D, for each stack between a side edge of the stack and the inclined surface with the dimension $D_2$ of one of the second stack being greater than the dimension $D_1$ of the first stack; and positioning the inclined surface on the mating configuration on the other stack at a location transversely offset from the location of the inclined surface on one side of the first stack so that when the two stacks are forced together an interference fit between the inclined surfaces will force the mating coupling formations to tightly engage each other and so forcing the mating coupling formations of the stacks together.

Further according to the invention, there are provided other methods and techniques for making and assembling the laminations, the stacks and the resulting transformer core assembly in a manner whereby good nesting engagement of the laminations is obtained and a good fit between the mating stacks is obtained with a tight, low vibration, interlocking fit between laminations and stacks thereof.

BRIEF DESCRIPTION OF THE DRAWINGS

FIG. 13 is a perspective view of a transformer core assembly formed from a stack of "E" shaped laminations and a stack of "I" shaped laminations formed as shown in FIG. 11B.

FIG. 14 is a perspective view of a transformer core assembly formed from two stacks of "E" shaped laminations as joined together in FIG. 12B.

FIG. 15 is an enlarged fragmentary plan view of the configuration of an interlocking surface on an end formation of an outer leg of an "E" lamination.

FIG. 16 is an enlarged fragmentary plan view of the inclined surface of an end formation of a middle leg of an "E" lamination.

FIG. 17 is an enlarged fragmentary plan view showing the connection between an end formation of an outer leg of an "E" lamination and a mating configuration on an opposed side edge of an "I" lamination.

DESCRIPTION OF THE PREFERRED EMBODIMENT

Figure 1:
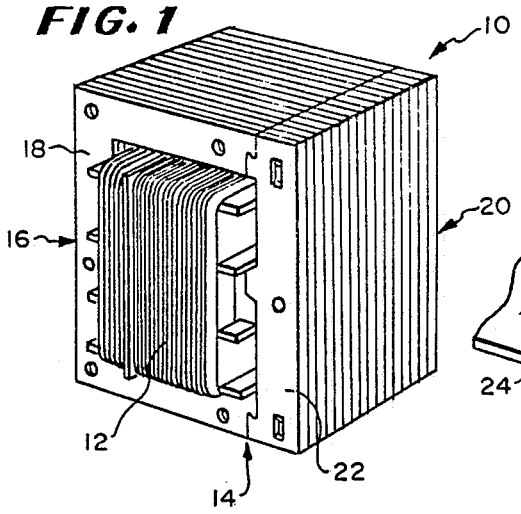
FIG. 1 is a perspective view of a transformer made from laminations and lamination stacks constructed according to the teachings of the present invention.

Referring to the drawings in greater detail, there is illustrated in FIG. 1 a transformer 10 including a coil 12 and a transformer core assembly 14 constructed according to the teachings of the present invention. In this embodiment, the transformer core assembly 14 is made up of a stack 16 of "E" shaped laminations 18 which are press fitted into interlocking engagement with a stack 20 of "I" shaped laminations 22 in accordance with the teachings of the present invention.

Figure 2:
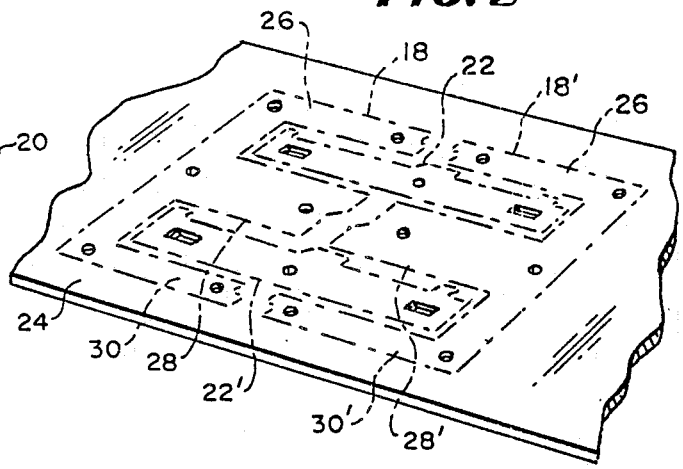
FIG. 2 is a fragmentary perspective view of a sheet of lamination material showing in phantom lines the laminations to be punched or stamped from the material.

The laminations 18 and 22, "E" shaped or "I" shaped, are formed from a sheet 24 of lamination material as shown in FIG. 2. In FIG. 2, the general outline of the lamination pieces 18, 22, 18′ and 22′ which are punched or stamped in a single punching or stamping of the sheet 24 of material, is shown in phantom lines. Here it will be seen that two "E" shaped laminations 18, 18′ and two "I" shaped laminations 22, 22′ are punched or stamped from the sheet 24 of material. The "I" shaped laminations 22, 22′ (hereinafter "I" laminations) are punched from the space between the upper legs 26, 26′ and middle legs 28, 28′ of the two "E" shaped laminations 18, 18′ (hereinafter "E" laminations) and the middle legs 28, 28′ and lower legs 30, 30′ of the "E" laminations 18, 18′.

Figure 3A:
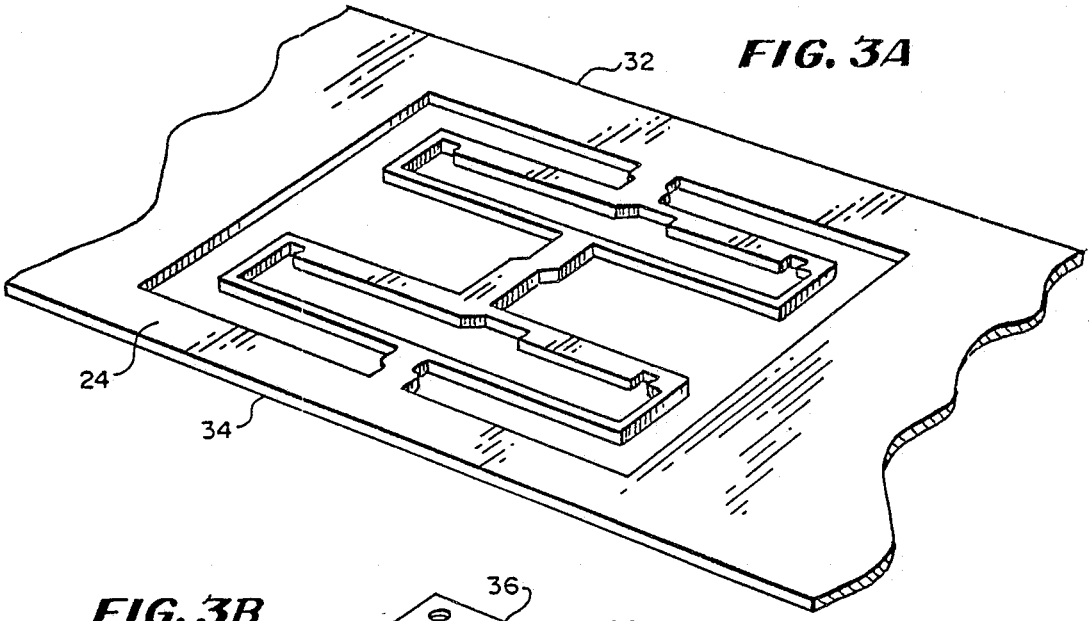
FIG. 3A is a perspective view similar to FIG. 2 and shows the material left in the sheet of lamination material from which the laminations are punched or stamped.
Figure 3B:
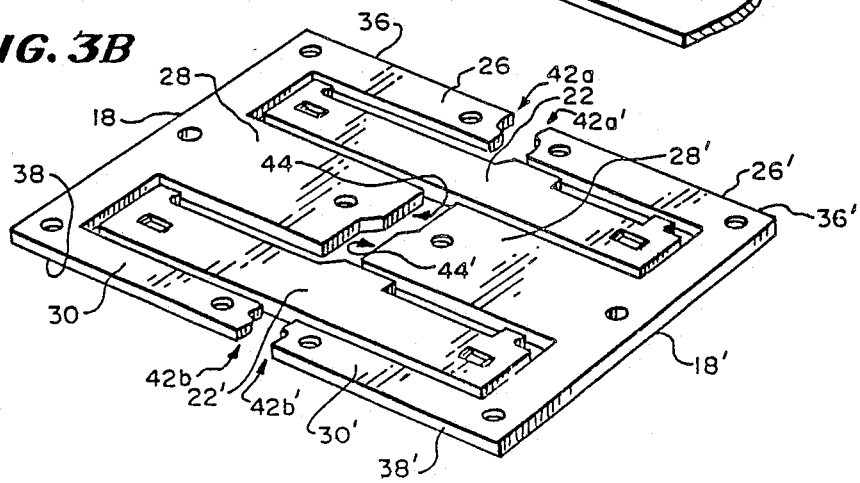
FIG. 3B is a perspective view of the lamination pieces punched or stamped from the sheet of material shown in FIG. 3A.

FIG. 3A shows the sheet 24 of material after the "E"and "I" laminations 18, 18′, 22, 22′ have been punched from the sheet 24 of material. FIG. 3B shows the resulting "E" laminations 18, 18′ and "I" laminations 22, 22′ which are punched from the sheet 24 of metal material.

For the purpose of facilitating illustration of the manner in which the laminations 18, 18′, 22, 22′ are punched or stamped from the sheet 24 of material, the sheet 24 of material is shown having a width between side edges 32, 34 which is greater than the height of the "E" laminations 18, 18′ formed therefrom and in actual practice, the upper and lower side edges 36, 38, 36′ 38′ of the "E" laminations 18, 18′ would be at or closely adjacent the opposite edges 32, 34 of the sheet 24 of material. Likewise, the middle area 40 between the opposing legs 26, 28, 30; 26′, 28′, 30′ of the two "E" laminations 18, 18′ can be closer together, depending upon the desired dimensions of the laminations 18, 18′, such that there is less scrap material in the punched out sheet 24 of material shown in FIG. 3A. Also, as will be described in greater detail hereinafter, the end formations 42*a*, 42*b*, 44; 42*a*′, 42*b*′, 44′ on the outer ends of the three legs 26, 28, 30; 26′, 28′, 30′ of the "E" laminations 18, 18′ can be and preferably are a mirror image to each other rather than a mating configuration as shown so that the "E" lamination 18 has to be turned upside down in order to be able to mate with the "E" lamination 18′.

Figure 8:
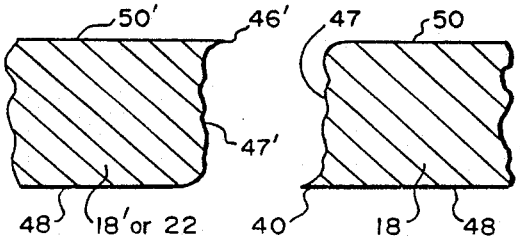
FIG. 8 is a fragmentary sectional view of the edge of one lamination having a burr at a lower corner and an upside down orientation of an adjacent lamination edge having a burr at an upper corner adapted to mate and nest with the other lamination edge.

This is preferred in order that a burr edge 46 at one corner of an edge 47 of a lamination 18 is at one side 48, e.g., a lower side 48 of the lamination 18, whereas a burr edge 46′ at the corner of an edge 47′ of a mating lamination 18′ is on the other or upper side 50 thereof to facilitate a smooth mechanical joinder of the adjacent edges as shown in FIG. 8.

Since the "E" laminations 18′ are substantially identical to the "E" laminations 18, only the "E" laminations 18 will be described in detail with reference to FIG. 4.

Figure 4:
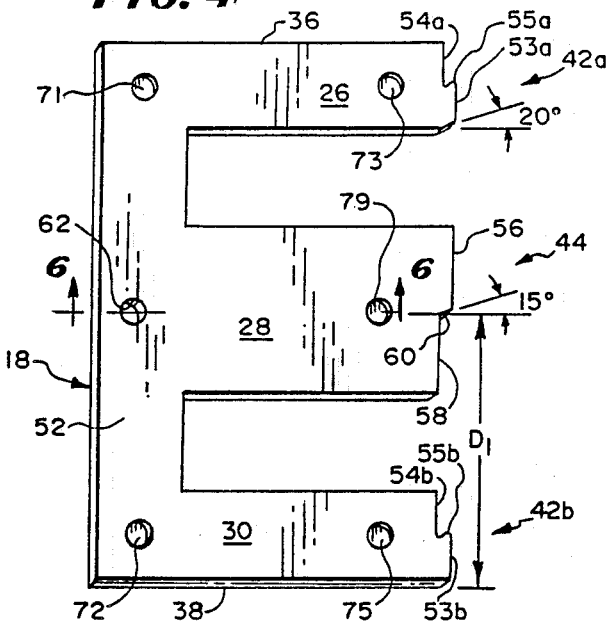
FIG. 4 is a perspective view of an "E" shaped lamination constructed according to the teachings of the present invention.

As shown in FIG. 4, each "E" lamination 18 has an elongate body portion 52 between the upper side edge 36 and the lower side edge 38 of the "E" formation. Extending from the elongate body portion 52 is the first, upper, outer leg 26, the middle leg 28, and the second, lower, outer leg 30. As shown, the first and second, upper and lower, outer legs 26 and 30 each have an end formation 42*a* and 42*b* which are identical to each other and which include an outer edge surface 53*a*, 53*b*, an inner edge surface 54*a*, 54*b*, and a connecting generally "S" shaped surface 55*a*, 55*b*.

The middle leg 28 has an outer end formation 44 which includes an outer edge surface 56, an inner edge surface 58 and an inclined edge surface 60 between the inner and outer edge . . . surfaces 56, 58.

A throughbore 62, such as for a bolt, is provided in the middle of the elongate body portion 52 adjacent an inner end 64 of the middle leg 28.

In the illustrated embodiment, the middle leg 28 is thicker or wider than the outer legs 26, 30 although any desired width or thickness of the middle leg can be provided.

For the purpose of facilitating the flat side to flat side joinder of "E" laminations 18, five generally circular metal displacements 71-75 of metal are formed in each "E" lamination 18 to form a depression or recess, e.g. depression or recess 84 (FIG. 6) on one side 50 and a detent, e.g. detent 94 on the other side 48. Metal displacement 71 is located at the upper end of the elongate body portion 52. Then, the metal displacement 73, 74 and 74 are located respectively in the upper outer leg 26, the middle leg 28 and the lower outer leg 30 just inwardly of the outer end formations 42*a*, 44 42*b* thereof.

Figure 6:
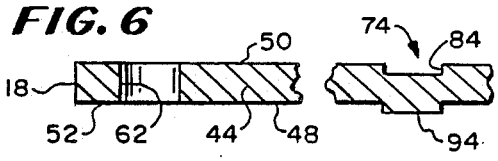
FIG. 6 is a fragmentary sectional view taken along line 6—6 of FIG. 4.

As shown in FIG. 6, each circular detent, e.g. detent 94 is formed by displacing part of the material in the lamination such that circular recess, e.g. recess 84 is formed on the upper 50 side opposite the detent, e.g. detent 94 on the lower side 48.

The other "E" laminations 18' can be as shown in FIG. 3B or can be mirror images of each other if two stacks of "E" shaped laminations 18, 18' are to be joined together to form a transformer core assembly (180 in FIG. 14).

Figure 5:
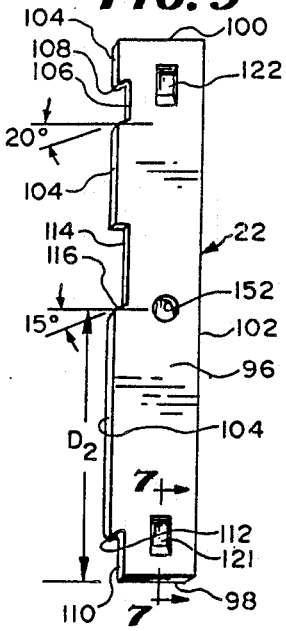
FIG. 5 is a perspective view of an "I" shaped lamination constructed according to the teachings of the present invention.

Since the "I" laminations 22 and 22' are substantially identical to each other, only the "I" lamination 22 will be described in detail with reference to FIG. 5. As shown in FIG. 5 the "I" shaped lamination 22 includes an elongate body 96 having a lower end edge 98 and an upper end edge 100, a generally smooth outer side edge 102, and a specially configured inner side edge 104 which is configured to mate with the end formations 42*a*, 44 and 42*b* of the "E" lamination 18 shown in FIG. 4. In this respect, the inner edge surface 104 has an upper inwardly disposed surface 106 joined by an "S" shaped surface 108 to an upper portion of the inner side edge surface 104. Likewise, at the lower end of the "I" lamination 22, an inwardly disposed surface 110 is spaced inwardly from the upwardly extending inner edge surface 104 and is connected thereto by an "S" shaped surface 112.

Then, in the middle area of the inner edge surface 104, there is provided an inwardly disposed surface 114 and a short inclined surface 116 extending from the surface 114 to the inner edge surface 104. With this configuration, the "S" shaped surface 108 will engage with the ""S" shaped surface 55*a* of the end formation 42*a* on the upper outer leg 26, the inclined surface 116 will mate with the inclined surface 60 on the end formation 44 of the middle leg 28 and the "S" shaped surface 112 will mate with the "S" shaped surface 55*b* of the end formation 42*b* on the lower outer leg 30.

In accordance with the teachings of the present invention the location of the inclined surface 116 between the lower and upper end edges 98 and 100 is offset slightly upwardly from the location of the inclined surface 60 of the outer end formation 44 of the middle leg 28 between the upper and lower side edges 36, 38 of the "E" lamination 18. The offset or mismatch D2 (FIG. 5) −D1 (FIG. 4) can be between 0.001 and 0.010 inch. In one embodiment, the offset or mismatch was 0.002 inch. This results in the "S" shaped surface 108 being forced against the "S" shaped surface 55*a* and the "S" shaped surface 112 being forced against the "S" shaped surface 55*b* as a result of the camming action between the two inclined surfaces 116 and 60 when the "E" and "I" laminations 18 and 22 are brought together or stacks 16, 20 of each of these laminations are brought together as will be described in further detail below.

The camming action causes the laminations 18, 18', 22, 22' and the lamination stacks 16, 20 formed therefrom to mechanically engage each other in an interference fit which locks them tightly together and minimizes vibrations in the laminations. The lamination stacks 16, 20 formed in this manner and the resulting transformer core assembly 14 formed from two stacks of laminations is very rigid with good metal-to-metal contact and low reluctance.

Figure 7:
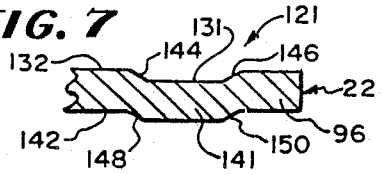
FIG. 7 is a fragmentary sectional view taken along line 7—7 of FIG. 6.

To facilitate forming the "I" laminations 22, 22' into an interlocking tight stack 20 of "I" laminations 22, 22', each "I" lamination 22, 22' is provided with two metal displacements 121, 122 each of which forms a generally rectangular recess, e.g. recess 131, on one, upper, side surface 132 of each lamination 22 and 22' and a generally rectangular detent 141 on the other, lower side 142 of the lamination 22. The metal displacement 121 is located adjacent the lower end edge 98 and the metal displacement 122 is located adjacent the upper edge 100 as shown in FIGS. 5 and 7. The metal is displaced in a manner so as to form two inclined edges, e.g. edges 144, 146 in each generally rectangular recess, e.g. recess 131. This results in a generally rectangular shaped detent, e.g. detent 141 which has opposed inclined surfaces 148 and 150 as shown in FIG. 7.

Each "I" lamination 22, 22' also has a throughbore 152 therein for receiving a bolt, such throughbore 152 being located midway between the upper and lower ends of the "I" lamination 22.

In accordance with the teachings of the present invention and as described above, the "E" and "I" laminations 18, 18', 22, 22' are punched or stamped from a sheet 24 of lamination material such that one set of laminations 22 or 18' in the stack 20 has to be stacked in an upside down manner relative to the other stack 16 of laminations 18 so that when they are joined together the edges 47, 47' mate or nest with each other with the burr edge 46 formed from the punching or stamping operation along one corner of each lamination 18 being located on one side 48 of each lamination in one stack of laminations and the burr edge 46' on each lamination 22 in the other stack 20 of laminations being located on the other side 50' as shown in FIG. 8. This facilitates the mechanical forcing of the lamination stacks 16 and 20 together.

Figure 9A:
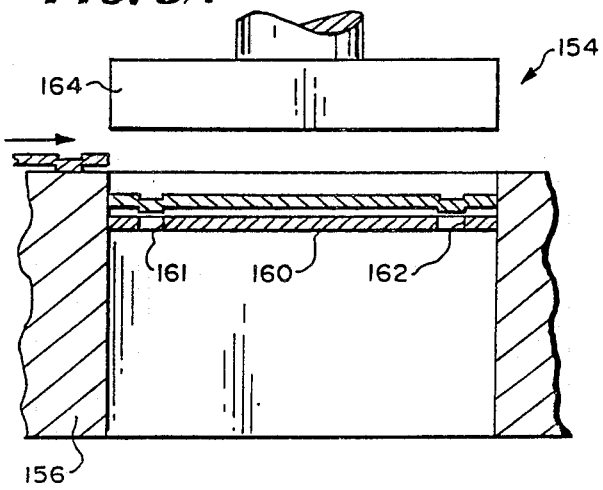
FIG. 9A is a fragmentary vertical elevational view of a lamination stacking chute or form and shows a ram which forces the laminations into the chute or form.

In FIG. 9A is shown a method by which a stack of "E" or "I" laminations is formed in a forming apparatus 154 which includes a form, cavity or chute 156 that has dimensions so that there is an interference fit between the form 156 and the laminations 18, 18', 22 or 22' that are pressed into the form or chute 156.

It will be noted that the first or lowermost lamination 160 that is pressed into the chute is formed with holes, e.g. 161, 162 that extend through the lamination 160 rather than merely displacing metal to form metal displacements, e.g. displacements 71-75 and 121, 122. This is done so that there are no protrusions on either side of the stack 16 or 20 of laminations formed. This applies to both laminations and laminations.

After a first lamination 160 having holes therethrough is pressed into the form 156 by a ram 164 a second lamination 18, 18', 22 or 22' is then pressed into the form or chute 156 into engaging interlocking relationship with the first lamination 160.

Figure 9B:
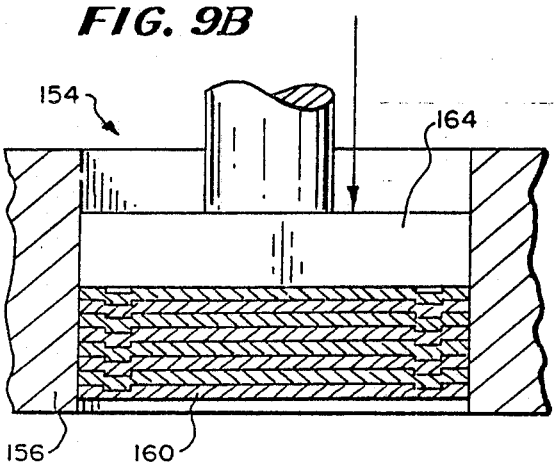
FIG. 9B is a fragmentary sectional view of the lamination chute or form shown in FIG. 9A and shows the ram after it has pushed a number of laminations into the chute or form.

Subsequently and sequentially, additional laminations are placed over the form or chute 156 and then pressed into the form or chute 156 by the ram 164 until a desired tack 166 of laminations has been formed as shown in FIG. 9B.

Figure 10A:
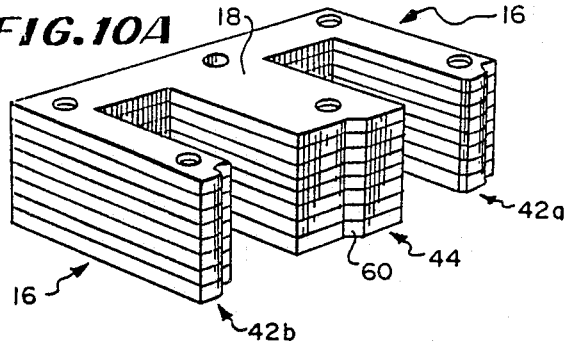
FIG. 10A is a perspective view of a stack of "E" shaped laminations constructed according to the teachings of the present invention.
Figure 10B:
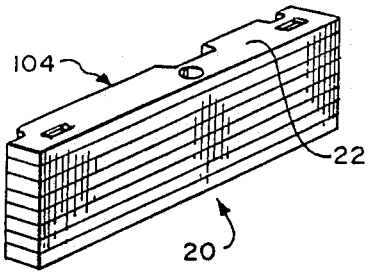
FIG. 10B is a perspective view of a stack of "I" shaped laminations constructed according to the teachings of the present invention.

A resulting stack 16 of "E" laminations 18, 18' is shown in FIG. 10A and a resulting stack 20 of "I" laminations 22, 22' is shown in FIG. 10B.

Also, according to the teachings of the present invention, the "I" laminations 22, 22' that are used to form the stack 20 are stamped from the same area of the blank sheet 24 of lamination material as are the "E" laminations 18, 18' in the stack 16 shown in FIG. 10A. As a result, the height of each stack 16, 20 is substantially identical so that mismatch of the stacks is avoided.

Figure 11:
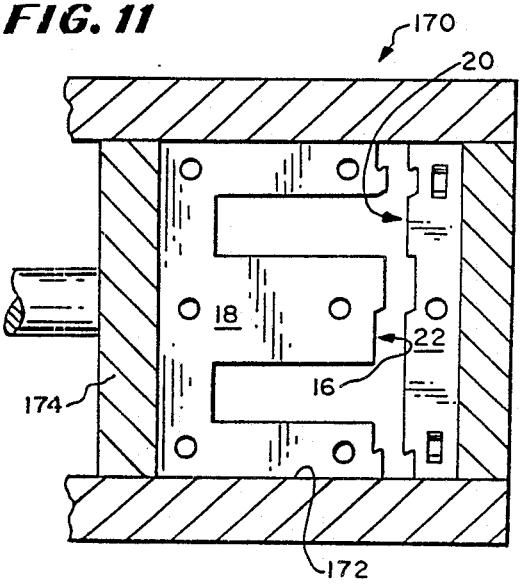
FIG. 11A is a sectional view of a transformer core forming apparatus and shows a cavity or form in which a stack of "E" shaped laminations is forced into engagement with a stack of "I" shaped laminations by a ram prior to engagement of the stacks.
FIG. 11B is a view similar to FIG. 11A and shows the lamination stacks joined together.

Once a stack 16 of "E" laminations 18, 18' as shown in FIG. 10A and a stack 20 of "I" laminations 22, 22' as shown in FIG. 10B are formed, the two stacks 16, 20 are placed in a core assembly forming apparatus 170 including a cavity or form 172 and a ram 174. The outer end formations **42*a*, 44, 42*b* on the legs 26, 28 and 30 of the "E" laminations 18, 18' in the stack 16 of "E" laminations 22, 22' are then forced into engagement with the specially configured mating, inner side edge surfaces of the "I" laminations 22, 22' in the stack 20 of "I" laminations 22, 22' as shown in FIG. 11A. This results in a mechanical forcing of the end formations 42*a*, 44 and 42*b* into engagement with the mating surfaces 104, 106, 108, 114, 116, 110 and 112 on inner side of the stack 20 of "I" laminations 22, 22' as shown in FIG. 11B to form a transformer core assembly 14**.

Figure 12A:
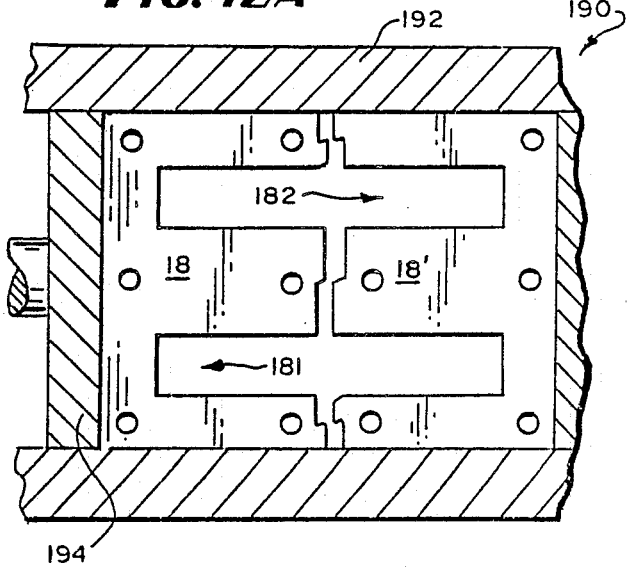
FIG. 12A is a view similar to FIG. 11A and shows two stacks of "E" shaped laminations in a cavity of a transformer core forming assembly positioned to be forced together by a ram.
Figure 12B:
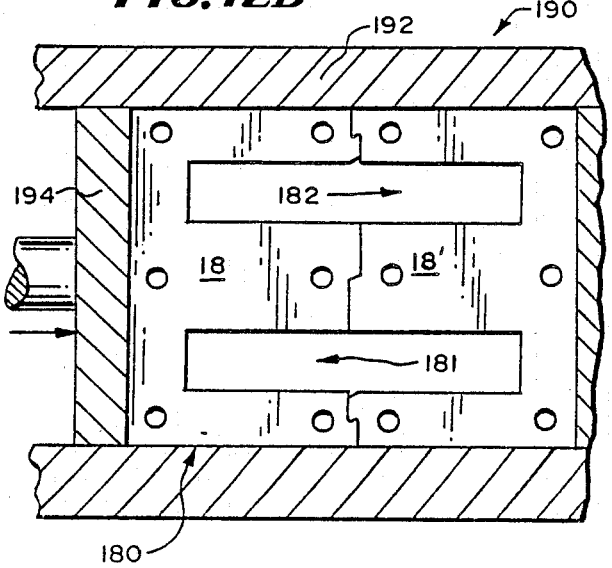
FIG. 12B shows the stacks of "E" shaped laminations joined together.

Similarly, a transformer core assembly 180 formed from two stacks 181 and 182 of "E" laminations 18, 18' is formed by mechanically forcing opposed outer end formations **42*a*, 44, 42*b* of the legs 26, 28, 30 of each stack 181, 182 into a mechanical interlocking engagement with each other using a forming apparatus 190 including a cavity or form 192 and a ram 194 as shown in FIGS. 12A and 12B**.

Typically a coil 12 is mounted on the middle leg(s) 28, prior to forcing of the stacks 16 and 20 (or 181, 182) together. The coil 12 has been omitted from FIGS. 11A–14 to better illustrate the core assemblies 14 and 180.

Figure 11B:
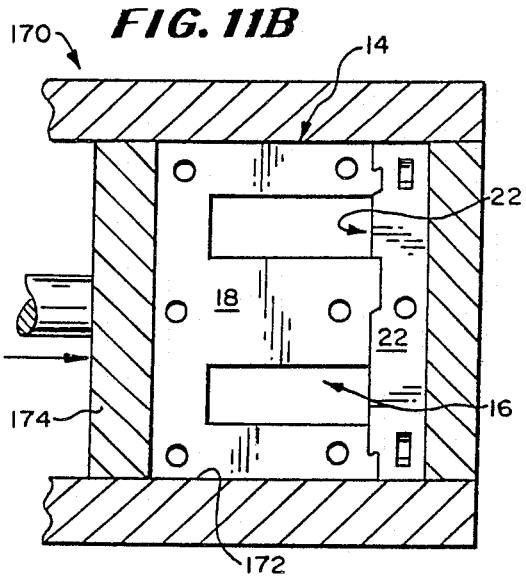

The transformer core assembly 14, shown in FIG. 11B, is shown in perspective in FIG. 13. Likewise, transformer core assembly 180 shown in FIG. 12B is shown in perspective in FIG. 14.

As shown in FIG. 15, each of the outer end formations **42*a*, 42*b* has S shaped surface 55*a*, 55*b* formed by a round 196 between the outer edge surface 53*a*, 53*b* and a straight portion 198 of the S and a fillet 200 between the straight portion 198 and the inner surface 54*a*, 54*b*. The straight portion 198 is at an angle between approximately 5° and 45° to an elongate axis 202 of the respective leg 26 or 30 and, as shown, is preferably at an angle of approximately 20° to the axis 202. Each fillet 200 and each round 196** preferably has a radius between 0.005 and 0.300 inch. In one preferred embodiment, the radius was approximately 0.011 inch.

As shown in FIG. 16, the inclined surface 60 between the outer surface 56 and the inner surface 58 on an end formation 49 of a middle leg 28 is between 90° and 45° to the inner and outer surfaces 58, 56 and between 0° and 45° to an elongate axis 204 of the middle leg. In one preferred embodiment, the angle of the inclined surface 60 is approximately 75° to the inner and outer surfaces 58, 56 or 15° to the elongate axis 204 of the middle leg 28.

In FIG. 17 is shown a modified embodiment where a flat area 206 is provided between a fillet 208 and a straight portion 210 of the S. A similar flat portion 212 extends from a round 214 to the straight portion 210. Each flat area 206, 212 in one embodiment was between 0.010 and 0.020 inch.

From the foregoing description it will be apparent that the "E" laminations 18, 18' made according to the teachings of the present invention and "I" laminations 22, 22', the stacks 16 of "E" laminations, the stacks 20 of "I" laminations 181, 182, and the transformer core assemblies 14, 180 made therefrom have a number of advantages, some of which have been described above and others of which are inherent in the teachings of the invention.

More specifically, the method or technique of assembling laminations 18, 18', 22, 22' from a group of laminations stamped from the same area in a sheet 24 of blank lamination material results in lamination stacks 16, 20; 181, 182 which, when they are joined together, provide a transformer core assembly 14 or 180 in which both lamination stacks 16, 20; 181, 182 have substantially the same thickness. Furthermore, by arranging for the burr edge 46' from the stamping of laminations 18, 18:, 22, 22' to be on one side of each lamination in a stack 16, 181 and the burr edge 46' on laminations 18', 22 in the other stack 20, 182 to be on the other side of each lamination, a better nesting and mating fit is obtained between the mating end formations **42, 44, 42*b*, 104 of two stacks 16, 20; 181, 182 of transformer laminations 18, 18', 22, 22'**.

The provision of circular and/or rectangular metal displacements 71-75, 121, 122 in each of the laminations 18, 18', 22, 22' allows them to be fitted together in a tightly interlocking stack 16, 20, 181, 182 of laminations. In addition, the provision of the offset inclined surfaces 60, 116 on the middle legs 28 and/or on the middle leg 28 and the mating edge surface 104 on an "I" lamination 22, 22' so that there is a camming action when the two stacks 16, 20; 181, 182 are forced together to provide a tight locking engagement between the stacks 16, 20; 181, 182. This tight locking engagement plus the tight connection between the laminations in each stack by reason of the detents and recesses results in a transformer core assembly 14, 180 that does not have to be embedded in a lacquer, varnish or epoxy to hold the pieces together and prevent vibrations. Further, by not using any liquid fixation material, a good metal-to-metal contact and resulting low reluctance is provided.

It will also be apparent that modifications can be made to the laminations, the stacks formed therefrom and the transformer core assemblies formed from the stacks without departing from the teachings of the present invention. Accordingly the scope of the invention is only to be limited as necessitated by the accompanying claims.

I claim:

1. A method for forming a transformer core assembly with a mechanical interference fit between first and second lamination stacks forming the transformer core assembly, said method comprising the steps of:

providing two stacks of laminations;

providing identical coupling formations at two spaced apart locations on one side of one stack of laminations;

providing offset side surfaces connected by an inclined surface intermediate the two coupling formations;

providing one side of the other stack of laminations with a mating configuration;

providing a dimension, D, for each stack between a side edge of the stack and the inclined surface with the dimension $D_2$ of the second stack being greater than the dimension $D_1$ of the first stack; and positioning the inclined surface on the mating configuration on the other stack at a location transversely offset from the location of the inclined surface on one side of the first stack so that when the two stacks are forced together an interference fit between the inclined surfaces will force the mating coupling formations to tightly engage each other and so forcing the mating coupling formations of the stacks together.

2. The method according to claim 1 including the step of providing each coupling formation with an outwardly disposed surface and inwardly disposed surface and an "S" shaped surface connecting the inner and outer surfaces.

3. The method of claim 1 where the dimension $D_2$ minus $D_1$ is between approximately 0.001 inch and 0.010 inch.

4. The method of claim 1 wherein the dimension $D_2$ minus $D_1$ is approximately 0.002 inch.

5. The method of claim 1 wherein said step of providing the forming of the two stacks of laminations comprises the steps of: punching or stamping from a generally rectangular area from a blank lamination material to "E" shaped laminations and two "I" shaped laminations from the area between the legs of the "E" shaped laminations; sequentially collecting the stamped laminations in exact quantities needed for a transformer core assembly having a predetermined height; assembling those sequentially collected laminations into mating stacks; and joining the mating stacks together to form a transformer core assembly with the laminations of one stack being stamped from the same area as the laminations from the other stack so that the height of one stack is substantially equal to the height of the other stack.

6. The method of claim 1 wherein said step of providing two stacks of laminations comprises the steps of: providing a set of laminations for forming a stack of laminations; providing one lamination in said set with a predetermined number of holes therein; providing in the other laminations of the set metal depressions equal in number to the holes in the one lamination, each metal depression resulting in a recess in one side of each lamination and a detent on the other side of each lamination; pressing one lamination of the set with metal depressions therein into engagement with the lamination with holes therein; and sequentially pressing each remaining lamination of the set into engagement with the last pressed lamination so as to form a stack of interlocking laminations without any end protrusions.

7. The method of claim 1 wherein said step of providing two stacks of laminations comprises the steps of: providing individual laminations; assembling the laminations in one stack of the laminations with the upper side of each lamination adjacent the lower side of an adjacent lamination and positioning all the laminations in the other stack upside down or inverted from the laminations in the first stack so that a burr edge at the corner edge of each lamination, formed in a stamping or punching operation, on one stack of laminations will be opposite a non-burr edge at the corner edge of each of the laminations in the other stack.

* * * * *